United States Patent [19]

Alon

[11] Patent Number: 4,651,648

[45] Date of Patent: Mar. 24, 1987

[54] PYROTECHNIC AIRCRAFT CARRIED BOMB

[75] Inventor: Ely Alon, Petach Tikva, Israel

[73] Assignee: The State of Israel, Ministry of Defence, Israel Military Industries, Israel

[21] Appl. No.: 846,891

[22] Filed: Apr. 1, 1986

[51] Int. Cl.[4] ..... F42B 25/02; F42B 13/44

[52] U.S. Cl. ..... 102/387; 102/334; 102/337; 102/338; 102/339; 102/340; 102/354; 102/357; 102/360; 102/369

[58] Field of Search ..... 102/334, 337–340, 102/345, 352, 354, 357, 360, 367, 370, 369, 387

[56] References Cited

U.S. PATENT DOCUMENTS

| | | | |
|---|---|---|---|
| 1,090,007 | 3/1914 | Ziegenfuss | 102/339 X |
| 1,108,654 | 8/1914 | Ziegenfuss | 102/338 |
| 2,124,876 | 7/1938 | Driggs | 102/339 |
| 3,038,407 | 6/1962 | Robertson et al. | 102/340 |
| 3,055,300 | 9/1962 | Stoehr | 102/339 |
| 3,112,906 | 12/1963 | Zeyher | 102/387 X |
| 3,633,509 | 1/1972 | Grandy et al. | 102/338 |

FOREIGN PATENT DOCUMENTS

| | | | |
|---|---|---|---|
| 558829 | 1/1944 | United Kingdom | 102/338 |

*Primary Examiner*—David H. Brown

*Attorney, Agent, or Firm*—Steinberg & Raskin

[57] ABSTRACT

A pyrotechnic, aircraft carried bomb such as a smoke bomb, illumination bomb, flare bomb and the like. The bomb comprises detachable delay and nose sections and two main body sections separable from each other and each holding a pyrotechnic charge. The tail section houses a braking parachute which is deployed by the action of a time fuze upon release from the carrier aircraft. The tail and nose sections further house each a main parachute associated each with one of the main body sections. After a certain delay the deployed braking parachute starts an ignition train which causes ejection of the tail and front sections, deployment of the main parachutes, separation of the two main body sections from each other and ignition of the pyrotechnic charges therein. The two main body sections parachute down and reach the ground in soft landing with the pyrotechnic charges burning during the descent and, if desired, they may be arranged to continue to burn for a while after landing, e.g. in case of a smoke bomb.

10 Claims, 5 Drawing Figures

PYROTECHNIC AIRCRAFT CARRIED BOMB

BACKGROUND OF THE INVENTION

In my U.S. patent application Ser. No. 822,048 of Jan. 24, 1986 there is disclosed a pyrotechnic aircraft carried bomb comprising a main body section and detachable nose and tail body sections with pyrotechnic means and at least two deployable main parachutes in said main body section. The bomb also comprises a braking parachute within said tail section deployable by ejection in axial direction from the rear which braking parachute slows down the bomb after its release from an aircraft. At some point in the downward travel of the bomb the tail and nose sections are ejected and the main parachutes are deployed, the pyrotechnic effect starting to develop in the main body as it parachutes slowly down to the ground.

In accordance with one embodiment described in said patent application the main bomb section is divided into two sub-sections each comprising a parachute compartment and smoke chamber. After the bomb according to that embodiment is released from the carrier aircraft and the braking parachute is deployed, and after some further delay of time, the tail and nose sections are ejected and the two sub-sections of the main bomb section are separated from each other each deploying its own parachute whereby the two bomb sections parachute down separately.

The present invention aims at providing a particularly useful design for a pyrotechnic aircraft carried bomb of the kind that separates into two parts each comprising a parachute of its own, superior to and different from the one described in a general manner in my U.S. patent application Ser. No. 822,048.

SHORT DESCRIPTION OF THE INVENTION

With this object in view of the invention provides a pyrotechnic aircraft carried bomb comprising detachable tail and nose sections; first and second main bomb sections adjacent, respectively, to said tail and front body sections and holding pyrotechnic charges; a separation device located between said first and second bomb 25 sections and adapted to be pressurized by combustion gases; a braking parachute housed in folded state within said tail section and deployable by ejection in axial direction; a first parachute linked to said first main bomb section housed in folded state in said tail section separate from said braking parachute; a second parachute linked to said second main bomb section housed in folded state within said nose section; an ignition train comprising an igniter operable by said braking parachute, a first axial passage way extending through said first main bomb section, a second axial passageway extending through said second main bomb section, ignition relays at the aft and fore ends of each of said axial passageways; means for initiating combustion of the pyrotechnic charge in said first main bomb section near the aft end thereof (first ignition zone); means for initiating combustion of the pyrotechnic charge in said second main bomb section near the fore end thereof (second ignition zone); and a time fuze adapted to deploy said braking parachute thereby to operate said igniter.

The term "ignition relay" is used herein to denote a body of readily ignitable material such as, for example, boron, adapted to be ignited by the propagating flame and thus to cause further propagation of the ignition. One important feature by which the bomb according to the invention is distinguished from and excels over the one according to my U.S. patent application Ser. No. 822,048 is the fact that the main parachutes are located in the tail and nose sections, respectively, rather than in special compartments. In this way additional space for payload is made available which is of significant advantage. Further distinctions and advantages will become apparent from the following description.

When a bomb according to the invention is released from the carrier aircraft the time fuze is set into operation and after a preset delay the fuze ejects itself by igniting a propellant charge therein whereby the braking parachute is deployed. In a preferred embodiment the time fuze is mechanical and is associated with an arming wire that is tied to the carrier lugs from which the bomb is suspended from the aircraft. When the bomb is released the wire remains tied to the aircraft and in consequence it is withdrawn from the time fuze whereby the fuze is armed and activated after the preset delay.

Once the braking parachute is deployed the igniter is operated by which a delay charge is ignited which after a predetermined time delay of say 3 seconds, ignites a first ignition relay and the resulting flame propagates from the tail to the nose section along said ignition train. This flame propagation causes the following to occur practically simultaneously:

1. The nose and tail sections are separated and ejected.
2. The pyrotechnic charge in the first and second main bomb sections are ignited.
3. The separation device is pressurized by combustion gases whereby the first and second main bomb sections are separated from each other.
4. The first and second parachutes are deployed.
5. The main bomb section parachutes down and arrives on the ground in a soft landing.

From the moment the parachutes of the main body sections are deployed combustion of the pyrotechnic charge inside the main bomb sections continues and depending on the design the combustion also continue on the ground. For example, where the bomb according to the invention is a smoke bomb, smoke generation on the ground will continue for a time sufficient to produce the desired smokescreen.

The pyrotechnic bomb according to the invention may serve as a smoke bomb, an illumination or flare bomb or for any other pyrotechnic purpose.

DESCRIPTION OF THE DRAWINGS

For better understanding one embodiment of the invention will now be described by way of example with reference to the accompanying drawings in which.

DESCRIPTION OF A PREFERRED EMBODIMENT

Figure 1:
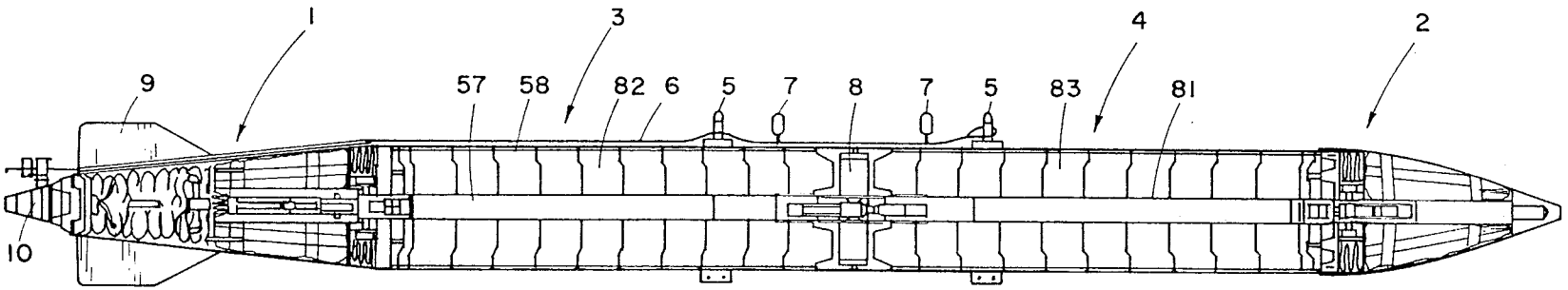
FIG. 1 is a longitudinal section through a pyrotechnic bomb according to the invention.

The pyrotechnic bomb according to the invention shown in FIGS. 1–4 is assumed to be a smokescreen bomb. It comprises a tail section 1, an ogival nose section 2, a first main bomb section 3 and a second main bomb section 4. On its outside the bomb comprises a pair of hooks 5 for suspension from carrier lugs of an aircraft and an arming wire 6 provided with loops 7 which are also attached to suspension means of the carrier aircraft.

Between the two main sections 3 and 4 there is located a separator device 8. The tail portion 1 comprises stabilizing fins 9 and time fuze assembly 10.

Figure 2:
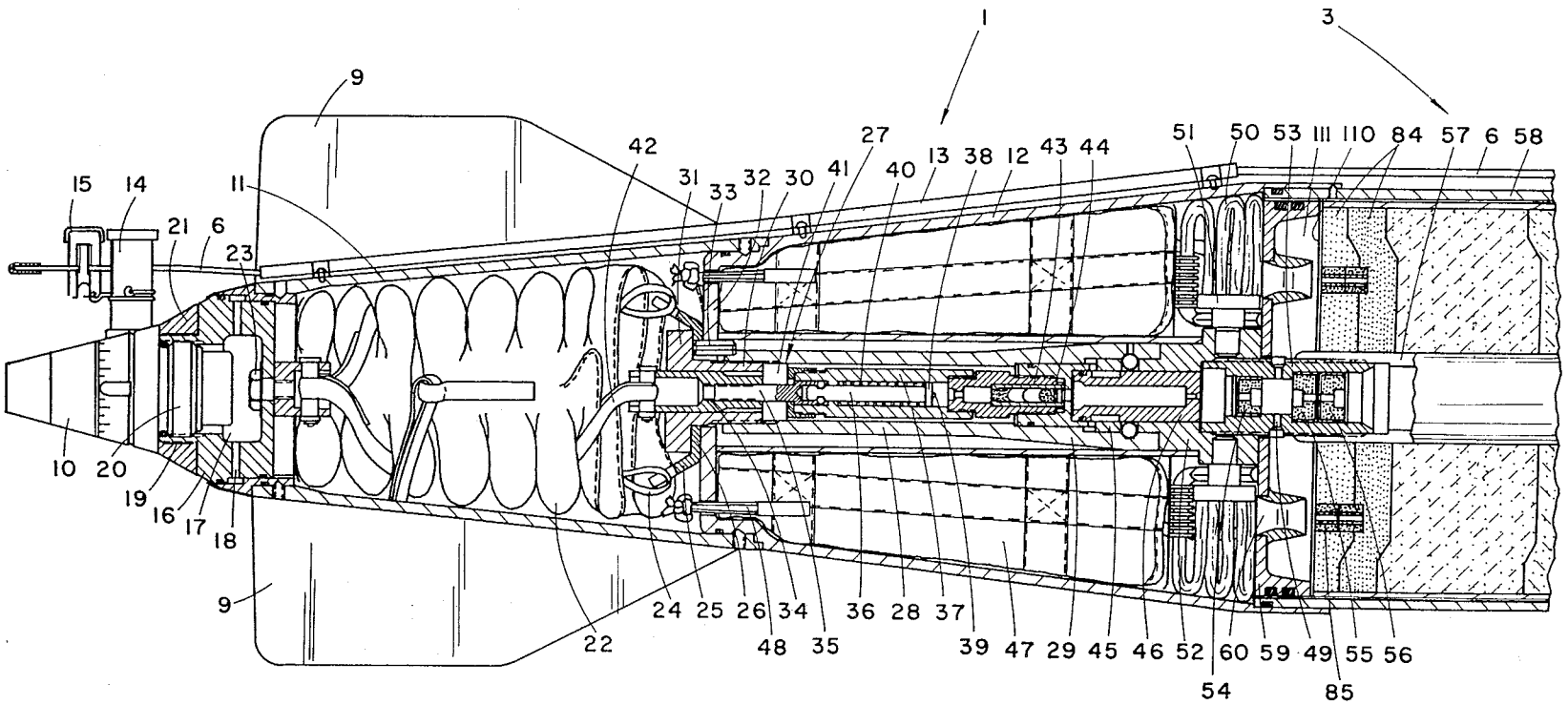
FIG. 2 is a longitudinal section of the tail portion of the bomb of FIG. 1, drawn to a large scale

The tail section 1 and its attachment to the first main section 3 will now be described in detail with reference to FIG. 2. As can be seen in that Figure the tail section 1 comprises a frustconical sleeve 11 in interlocking engagement with a cup-shaped body member 12. Extending on the outer side of the tail section 1 is a tube 13 which serves as guide for the arming wire 6 whose rear end is received by the fuze 14 of time fuze assembly 10. Near the loose end of wire 6 there is provided a safety clip 15. The rear opening of the tail portion 1 is sealed by a plug 16 having an inner chamber 17 and radial bores 18 and further comprising an internally screw-threaded neck portion 19 into which there is screwed the hub 20 of time fuze 10 which is also supported by a frustoconically shaped nut 21 screwed onto the external screw threads of neck portion 19.

Sleeve portion 11 of the tail section 1 houses a braking parachute 22 whose central portion is anchored in plug 16 by means of a screw 23 while its rim portion is retained by means of loops 24 engaging hooks 25 extending radially from a ring 26 forming part of a striker assembly 27.

The striker assembly 27 comprises a cylinder 28 with a terminal flaring portion 29, a bushing 30 screwingly coupled with cylinder 28 and having a circular flange 31, ring 26 being clamped between flange 31 and the end wall 32 of the cup-shaped body member 12. The angular positions of flange 31, ring 26 and end wall 32 are fixed by means of pins such as pin 33.

A plug 34 is slidingly received by bushing 30 and comprises screwingly secured thereto a rod 35 which is coupled with a plunger 36 by means of ball-and-socket coupling in the manner shown. Plunger 36 comprises a head 38 fitted with a striker pin 39 and is reciprocable within a cylinder 37. A helical spring 40 is coiled on plunger 36, the spring being confined between head 38 and a shoulder of the cylinder 37. A chamber 41 separates the rear portion of cylinder 37 from bushing 30 and plug 34 is linked to the braking parachute by means of a rope 42.

A delay igniter 43 having a primer adapted to be struck by striker pin 38 is coupled at one end with a cup-shaped terminal portion of cylinder 37 and at the other end with a bushing 44 having an annular flange 45.

A centrally bored piston 46 having an annular recess is coupled to the flaring portion 29 of cylinder 28 by means of coupling balls engaging each a socket of the flaring portion 29 of cylinder 28 and being laterally confined between flange 45 and the rim portion of a sleeve 52. In the tubular space around cylinder 29 there is packed in an envelope 47 a first main parachute, ropes 48 being provided which are retained by end wall 32 of the cup-shaped body member 12 so that when the tail section is ejected envelope 47 is withdrawn and the said first main parachute is deployed. The said first main parachute is attached to the first main body section by means of ropes 50, held by screws 51 anchored in sleeve 52.

Sleeve 52 screwingly engages a cylindrical ignition relay device 53 holding relay charges 54, 55 and 56 and whose other end is engaged by an axial tube 57 by which the relay device 53 communicates with another relay device associated with the separation device 8 (see also FIG. 1). Ignition device 53 comprises radial bores 49 leading into a chamber 111 formed between the rear sealing plate 59 of main bomb section 3 and a diaphragm 110 thereof.

The rim portion of the cup-shaped body member 12 is sled in a tight fit on the cylindrical body member 58 of the first main bomb section 3.

Figure 3:
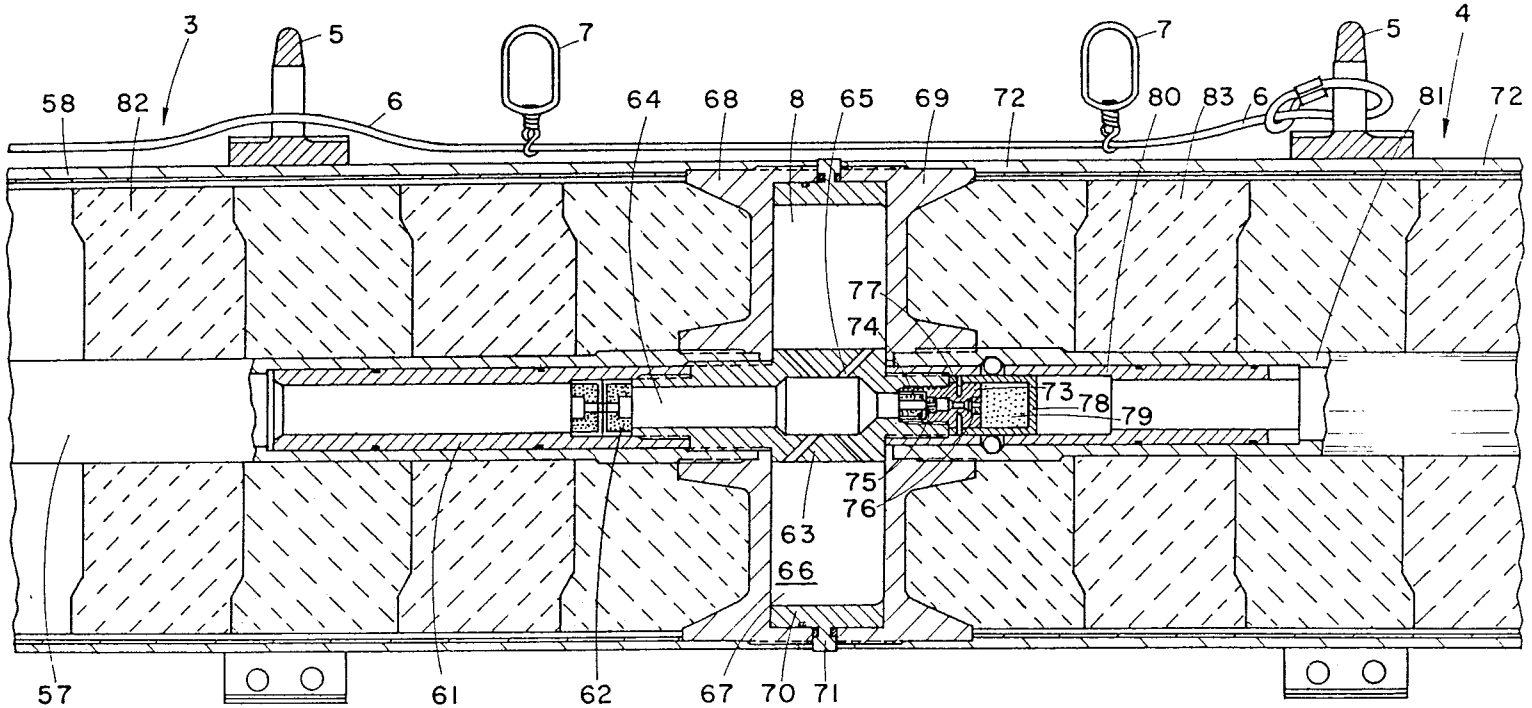
FIG. 3 is a longitudinal section of the median portion of the bomb of FIG. 1, showing portions of the first and second main bomb sections and drawn to a larger scale.

Attention is now directed in FIG. 3 where it can be seen that near the separator device 8 tube 57 merges into a cartridge 61 holding an ignition relay charge 62 in form of two boron pellets. Cartridge 61 is coupled with another cartridge 62 extending from main section 3 to main section 4 across the separator device 8. Cartridge 63 comprises a central tubular passage 64 and a number of bores 65 leading into an empty annular chamber 66. The annular chamber 66 is formed between sealing plates 68 and 69 of the first main bomb section 3 and the second main bomb section 4, respectively. Chamber 66 is sealed circumferentially by an ring 70 having an annular rib 71 projecting between reduced thickness rim portions of the cylinder body members 58 and 72 of the main bomb sections 3 and 4, respectively. The said rim portions are slidingly mounted on ring 70.

At its foreside cartridge 63 is coupled with yet another ignition relay cartridge 73 holding relay charges 74, 75 and 76. Cartridge 73 is coupled by means of shearing pins 77 to a cup-shaped piston 78 holding a propellant charge 79. Piston 78 is moveable (subject to the of shearing pins 77) within a cylinder 80 which is, on the one hand, screwingly coupled to the cartridge 63 and, on the other hand, detachably coupled by means of ball-and-socket coupling with an axial tube 81 extending through the second main bomb section 4. The coupling of cylinder 80 and tube 81 holds together the main bomb sections 3 and 4.

The main bomb section 3 holds a plurality of annular pyrotechnic charge bodies 82 and similarly bomb section 4 comprises a plurality of annular pyrotechnic charge bodies 83. At its aft end bomb section 3 comprises two annular ignition charge bodies 84 and relay charges 85 (see FIG. 2) and likewise the bomb section 4 comprises at its fore end two annular ignition charge bodies 86 and relay charges 87 (see FIG. 4). Ignition charges 84 are sealed by a diaphragm 110, chamber being formed between this diaphragm and sealing plate 59.

Figure 4:
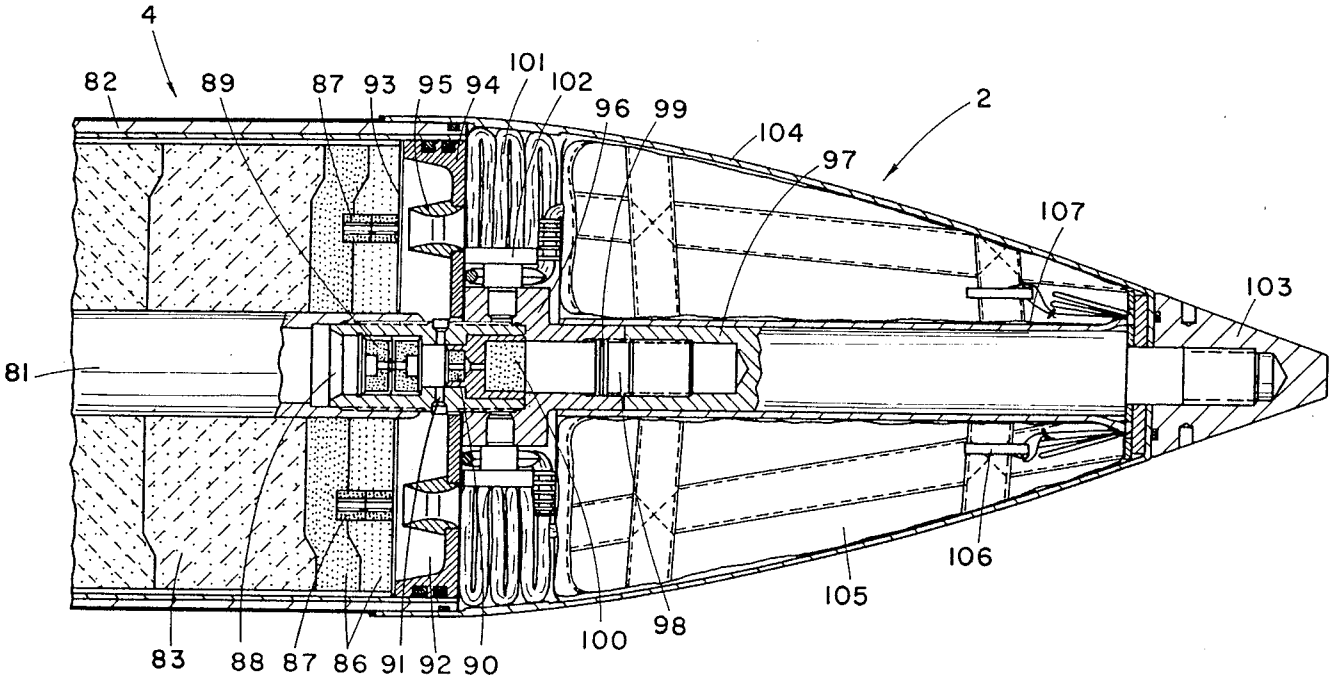
FIG. 4 is a longitudinal section of the nose section of the bomb of FIG. 1, drawn to a larger scale.

Attention is now directed to FIG. 4 and it is seen that near the fore end of bomb section 4 tube 81 is coupled with a cartridge 88 holding two similar relay charge pellets 89 and a further relay charge 90 and having radial passages 91 leading into a chamber 92 formed between a terminal diaphragm 93 sealing off the ignition charges 86 and a terminal sealing plate 94 of that section comprising vents 95.

A bushing 96 is screwingly coupled with cartridge 88 and aligned with bushing 96 is a cylindrical block 97 surrounded by a tubular insulating sheath 107. A piston 98 is screwingly coupled with both the bushing 96 and the block 97 thereby holding the bushing and sleeve together and in this way nose section 2 and main body section 4 are held together. The engagement between the piston 98 and bushing 96 is by means of a shearing thread 99 which is adapted to be sheared off when the piston moves forward. Between piston 98 and the cartridge 96 there is formed a chamber 100 which contains a propellant charge.

The nose section 2 houses a second main parachute contained within an envelope 105 and associated with the second main bomb section 4, which parachute is linked to the bomb section 4 by means of ropes 101 held by screws 102 anchored in bushing 96.

Nose section 2 has an ogival body member 104 whose rim is slid in a tight fit on the front rim portion of the cylindrical body member 72 of bomb section 4.

The front section 2 comprises a tip 103 linked by wires or ropes 106 to envelope 105 so that upon ejection of tip 103 and ogival body member 104 envelope 105 is withdrawn whereby the second main parachute is deployed.

The operation of the smoke bomb hereinbefore described is as follows:

Upon release of the bomb from the carrier lug of the aircraft, arming wire 6 is retained by the aircraft by means of loops 7 and is thus withdrawn from fuze 14 of the time fuze assembly 10. Consequently, after the bomb has flown for a pre-set time of say 2 to 50 seconds as a single unit as shown in phase (a) in FIG. 5, the time fuze assembly 10 ejects itself whereupon the seal 16 is unseated and the braking parachute 22 is deployed as shown in phase (b) of FIG. 5. In consequence of the drag of the deployed braking parachute 22, rod 35 is pulled to the rear pulling with it the plunger rod 36 thereby compressing spring 40 until the coupling balls face chamber 40 and drop into that chamber. By this rod 35 and plunger 37 are decoupled and the plunger assembly 36, 38 is urged forward by the action of the compressed helical spring 40 whereupon the striker 39 strikes the primer of delay igniter 43. After a predetermined time delay of say 3 seconds, the ignition from delay igniter 43 is transmitted to the centrally bored piston 46 which in consequence moves forward so that the flame reaches relay charge 54 of relay cartridge 53. The flame propagation from relay charge 54 ignites the second relay charge 55 of cartridge 53 which in turn ignites the third relay charge. The combustion initiated by charges 54 and 55 propagates through bores 112 to reach the relay charges 85 whereby the ignition charges 84 are ignited which in turn ignite the pyrotechnic charge 82 of the main body section 3 of the bomb.

In consequence of the forward movement of the piston 46 external recesses thereof come to be located opposite the coupling balls and in consequence thereof the sleeve 52 is decoupled from cylinder 28. At the same time combustion gases from the ignition flame expand into the flaring portion 29 of cylinder 28 and as a result of the combined action of these gases and of the drag of braking parachute 22, and tail section 1 is separated from the first main body section 3 and is ejected carrying with it envelope 47 of the first main parachute and in consequence the first main parachute is deployed.

The flame produced by the ignition of the third relay charge 56 of cartridge 53 propagates inside the axial tube 57 into cartridge 61 igniting the relay charges 62 and the resulting flame propagates into cartridge 63 expanding inside the empty chamber 66. The resulting pressure build-up causes the expansion of ring 70 and the separation of cylindrical bodies 58 and 72 from each other in the course of the separation of the main body sections 3 and 4 from each other (see below).

The combustion gases propagating inside cartridge 63 also ignite the relay charges 74, 75 and 76 and the propellant charge 79. In consequence of all this, the piston 78 is urged forward whereby the pins 77 are sheared and the piston moves forward until its front portion hits the shoulder inside cylinder 80. In consequence of the forward movement of the piston 78 the coupling balls are freed from below and fall into the space left behind the piston whereupon cylinder 80 and tube 81 are decoupled. In consequence of this decoupling the second main bomb section 4 is free to slide off cartridge 63 and bomb sections 3 and 4 are separated from each other.

The flame propagating from relay charges 74, 75, 76 and propellant charge 79 in piston 78 propagates through the axial tube 81 to ignite the relay charges 89 and 90 in cartridge 88. The gases propagating through bores 91 ignite the relay charges 87 which in turn ignite the ignition charges 86 and thereby the pyrotechnic charges 83.

The combustion gases resultingn from the ignition of relay charge 90 push forward piston 98 thereby shearing off the shearing thread 99. In consequence the piston 98 with block 97 move forward whereby tip 103 and ogival body member 104 are ejected, pulling with them envelope 105 whereby the second main parachute associated with main body section 4 is deployed.

Figure 5:
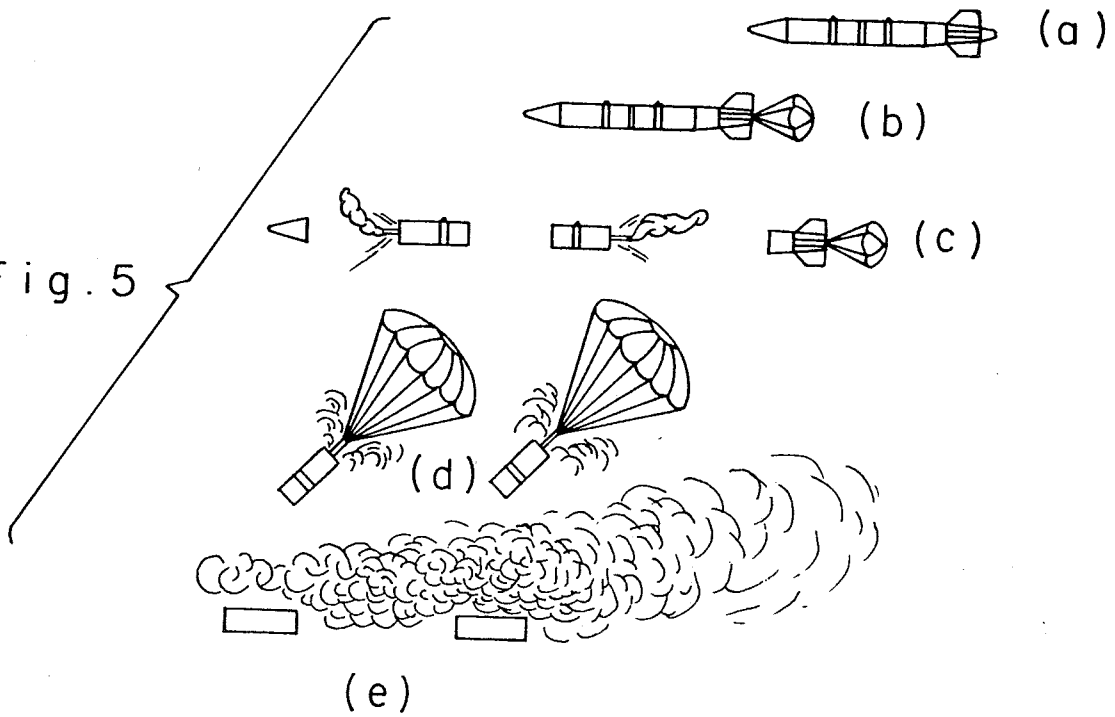
FIG. 5 is a diagrammatic illustration of the sequence of operation of a smokescreen bomb according to the invention.

While in the foregoing description the ejection of the tail section 1, deployment of the first parachute, the separation of the main bomb sections 3 and 4 from each other, ejection of the nose section (tip 103 and ogival body member 104) and deployment of the second parachute are described sequentially, in practice due to the very fast propagation of the flames and the combustion gases inside the axial tubes 57 and 81, all this occurs practically simultaneously so that upon the operation of the delay charge 43 the bomb is split into four parts as shown in phase (c) of FIG. 5.

As the main body sections 3 and 4 parachute down and also upon their soft landing, the combustion gases developing inside the main bomb sections, e.g. smoke in case of a smoke bomb, escape through vents 60 of end plate 59 of bomb section 3 and vents 95 of end plate 94 of bomb section 4.

I claim:

1. A pyrotechnic aircraft carried bomb comprising detachable tail and nose sections; first and second main bomb sections adjacent, respectively, to said tail and front body sections and holding pyrotechnic charges; a separation device located between said first and second bomb sections and adapted to be pressurized by combustion gases; a braking parachute housed in folded state within said tail section and deployable by ejection in axial direction; a first parachute linked to said first main bomb section housed in folded state in said tail section separate from said braking parachute; a second parachute linked to said second main bomb section housed in folded state within said nose section; an ignition train comprising an igniter operable by said braking parachute, a first axial passageway extending through said first main bomb section, a second axial passageway extending through said second main bomb section, ignition relays at the aft and fore ends of each of said axial passageways; means for initiating combustion of the pyrotechnic charge in said first main bomb section near the aft end thereof (first ignition zone); means for initiating combustion of the pyrotechnic charge in said second main bomb section near the fore end thereof (second ignition zone); and a time fuze adapted to deploy said braking parachute thereby to operate said igniter.

2. A bomb according to claim 1 wherein said time fuze is mechanical and is associated with an arming wire that is tied to the carrier aircraft.

3. A bomb according to claim 1 wherein said main parachutes are packed within envelopes tied, respectively to the tail and nose section, which envelopes are withdrawn when the tail and nose sections are detached from said main bomb sections.

4. A bomb according to claim 1 wherein a piston is located at the interface between said second main body section and nose section adapted to advance upon ignition of an associated ignition relay thereby to detach and eject said nose section.

5. A bomb according to claim 1 wherein terminal plates of the main body sections adjacent the associated parachutes comprise vents for the discharge of gases developed by combustion of the pyrotechnic charge.

6. A bomb according to claim 1 wherein said first and second ignition zones comprise ignition charges.

7. A bomb according to claim 1 wherein the attachments between the tail section and said first main body section comprises a ball-and-socket coupling.

8. A bomb according to claim 1 wherein the attachment between said first and second main body sections comprises a ball-and-socket coupling.

9. A bomb according to claim 1 wherein the attachment between said second main body section and nose section comprises a screw coupling with a shearing thread.

10. A bomb according to claim 1 being a smoke bomb.

* * * * *